United States Patent [19]

Hagar

[11] 4,376,513

[45] Mar. 15, 1983

[54] IRRIGATION STREAM SPLITTER

[75] Inventor: Jay L. Hagar, Grass Valley, Calif.

[73] Assignee: The Toro Company, Minneapolis, Minn.

[21] Appl. No.: 164,593

[22] Filed: Jun. 30, 1980

[51] Int. Cl.[3] ..... B05B 15/06; B05B 3/08

[52] U.S. Cl. ..... 239/231; 239/200

[58] Field of Search ..... 239/200, 78, DIG. 1, 239/227.13, 231, 498, 502, 522, 240

[56] References Cited

U.S. PATENT DOCUMENTS

| | | | |
|---|---|---|---|
| 1,491,253 | 4/1924 | Barnes | 239/231 |
| 2,954,934 | 10/1960 | Hatonaka | 239/231 |
| 3,664,590 | 5/1972 | Knight | 239/DIG. 1 |
| 4,191,331 | 3/1980 | Bivens et al. | 239/DIG. 1 |

*Primary Examiner*—James B. Marbert

*Attorney, Agent, or Firm*—James W. Miller

[57] ABSTRACT

An improvement to sprinkler heads used in tree orchards and the like wherein it is undesirable to have irrigation water maintaining the trunks of the trees in a constantly wet state. The sprinkler heads involved are the vertically disposed cylindrical type wherein a rotating nozzle at the top thereof creates a horizontal spray pattern. The improvement comprises a cylindrical collar for mounting on the sprinkle head body with at least one vertically dispoed wedge-shaped fin mounted thereon. By placing the fin radially between the nozzle opening of the sprinkler head and the tree trunk the wedge-shaped fin splits the stream which would otherwise strike the tree trunk and causes it to pass on either side of the tree trunk. Various embodiments are shown to provide adjustability of the fins position and a plurality of fins on one sprinkler head.

14 Claims, 15 Drawing Figures

Fig. 5.
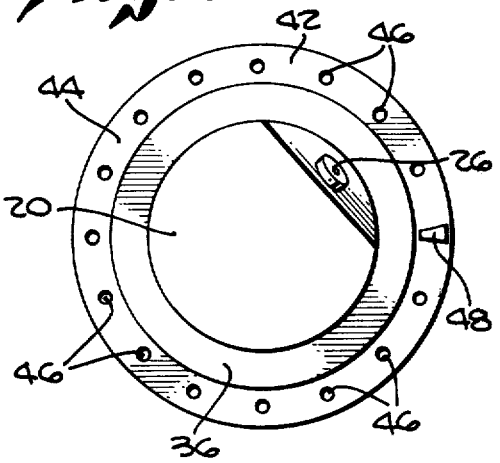
Fig. 9.
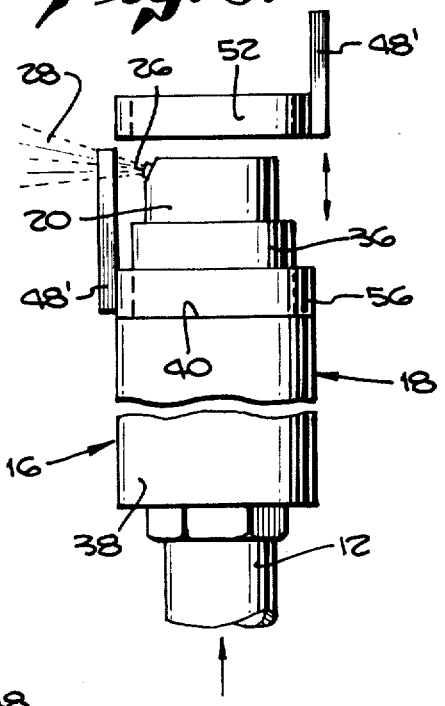
Fig. 6.
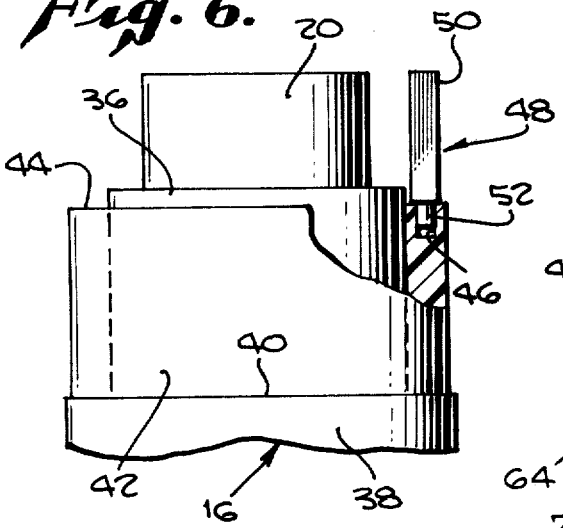
Fig. 10.
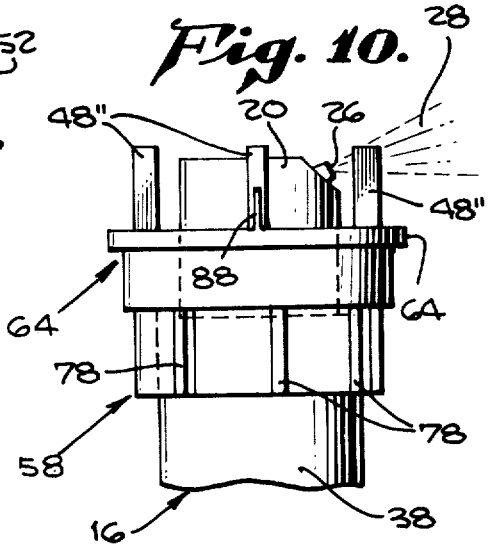
Fig. 7.
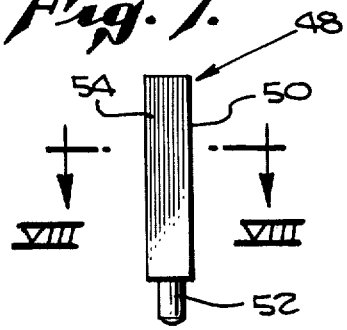
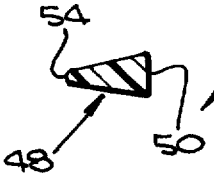
Fig. 8.

48"
92
90
88
64
66
48"
92
88
86

76
74
70
72
58
36
48"
68
60
62
68
48"
68
72
74
82
68
84
80
80
58
78
70
78

IRRIGATION STREAM SPLITTER

BACKGROUND OF THE INVENTION

Modern irrigation systems have provided a benefit to many agricultural applications. One such application is shown in FIGS. 1 and 2. In the growing of orchard crops, an underground pipe 10 is disposed throughout the orchard to provide a source of water under pressure. Periodically, riser pipes 12 are connected to the underground pipe 10 and vertically disposed as shown in FIG. 1 between one or more trees 14 to be watered thereby. The vertical riser pipes 12 have a sprinkler head 16 disposed thereon of the type shown in FIG. 3. Each sprinkler head 16 has a cylindrical body portion 18 adapted on the bottom end for attachment to the riser pipe 12 and having a nozzle portion 20 extending vertically from the top thereof along the longitudinal axis 22. The cylindrical body portion 18 has a turbine motor (not shown) disposed therein such that as irrigation water 24 entering from riser pipe 12 passes therethrough, nozzle portion 20 is rotated horizontally about the longitudinal axis 22 whereby the water 24 emerges from a nozzle opening 26 as a stream 28 which stream soon disperses and, thereby, creates the horizontal spray pattern 30 shown as the cross-hatched area in FIG. 2. Frequently in such orchards, a sprinkler head 16 creating a 360° spray pattern (i.e. a full circle) is placed between several trees 14 in the manner shown in FIG. 2. By using a sprinkler head 16 of the type creating a partial circular arc, one, two, or more trees 14 can also be watered, but such an approach would typically be more expensive and, therefore, unused.

While such sprinkler systems have afforded obvious benefits, certain orchard crops have also suffered detriment thereby. In particular, in such orchard crops as walnuts and almonds, the type of watering pattern necessary has also often created an associated problem of wood rot in conjunction with the crowns and roots of the trees.

Wood rotting diseases of particular concern to the walnut and almond orchard owners in California are Phytophthora (Crown Rot) and Poria. Crown Rot moves directly into and through live tissue and can open the door for Poria, a moisture loving organism that enters the dead, inner wood of the trunk and main roots. These diseases cause less production of almonds and walnuts, originally, and eventually to the loss of the infected tree. The problem is a growing one because of the trend towards permanent set sprinkler systems which, because of the need for frost protection, are commonly being designed with application rates as low as 0.065 inches per hour. This means that irrigation sets of up to 96 hours are necessary in the summer to satisfy the consumptive water use of the orchard, which, in turn, creates a humid environment suitable for fungi growth. From investigations made by the applicant herein, it appears that at least 50% of the walnut orchards in northern California, especially along the Sacramento River, are either experiencing Crown Rot now or have the potential for it. Over one-half of the 160 thousand acres of walnuts in California are in this area, with an annual crop value of over $1,000 per acre. In almonds, where it is estimated that 10–15% of the orchards are infested with Poria, the planted acres and permanent set systems are even larger, though the problem is not as severe. Over one hundred throusand acres of the nearly 270,000 acres planted in California are in this area. This means that over 10,000 acres of almonds, with approximately the same value per acre as walnuts, are either infected with, or have the potential for, Poria wood rot.

At present, there is no means for employing such sprinklers to irrigate such orchards without causing the wetting of the trunks of the tree at the same time. Wherefore, it is the object of the present invention to provide an improvement in such sprinkler systems to prevent the trunks of the trees from being maintained in a wet condition by the irrigation system, while, at the same time, providing full irrigation coverage to the area except for the trunks of the trees per se.

SUMMARY

The foregoing objective has been realized by the improvement of the present invention which comprises a cylindrical collar adapted to be concentrically disposed about the cylindrical body of the sprinkler head and a wedge-shaped fin member carried by the collar on one end and disposed vertically close adjacent the nozzle portion with the narrow edge of the wedge facing the nozzle opening when the nozzle opening, the tree, and the fin member are in radial alignment, whereby the emitted steam of irrigation water which would otherwise strike the tree trunk is split by the fin member and the fluid thereof is directed to the area on either side of the trunk of the tree.

In one embodiment shown, a single collar is provided with holes radially spaced about the upper edge thereof and a plurality of fin members are provided each having a cylindrical peg on one end whereby several such fin members can be inserted in the proper holes in the collar to place them between the nozzle portion and several trees being irrigated by the sprinkler head.

In another embodiment, the cylindrical collar is made relatively thin in the longitudinal direction and has one or more fins mounted on the outer pheriphery whereby several collars can be stacked on the cylindrical sprinkler head body and rotated thereabout to place the fins in the proper position for splitting the emerging fluid stream which would otherwise strike tree trunks.

In the preferred embodiment, as presently being commercially manufactured by the assignee of the present invention, two cylindrical collars are provided each having a pair of stream splitting fins disposed 180° apart. One collar is adapted to concentrically mount on the cylindrical sprinkler head and the second is adapted to concentrically mount on the first collar. The interfacing surfaces of the two collars are notched to allow adjustability of the positions of the stream splitting fins while preventing spontaneous misadjustment thereof due to the vibrations in the sprinkler head during the irrigation process.

DESCRIPTION OF THE DRAWINGS

FIG. 5 is a plan view of the collar of the present invention according to a first embodiment disposed on a sprinkler head of the type shown in FIG. 3.

FIG. 6 is an elevation view of the collar of FIG. 5 with a single stream splitting fin member mounted thereon.

FIG. 7 is an elevation view of a removable stream splitting fin as used with the collar of FIGS. 5 and 6.

FIG. 8 is a cut-away view of the fin of FIG. 7 in the plane VIII—VIII.

FIG. 9 is an elevation view of a sprinkler of the type shown in FIG. 3 with a pair of collars carrying stream splitting fins according a second embodiment of the present invention.

FIG. 10 is an elevational view of the preferred embodiment of the present invention as mounted on a sprinkler of the type shown in FIG. 3.

DESCRIPTION OF THE VARIOUS EMBODIMENTS

Figure 1:
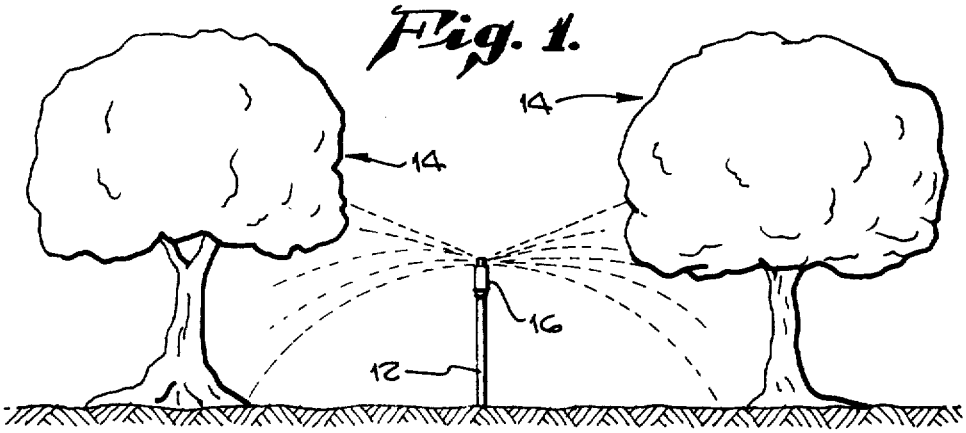
FIG. 1 is an elevation view of a sprinkler system irrigating an orchard.
Figure 2:
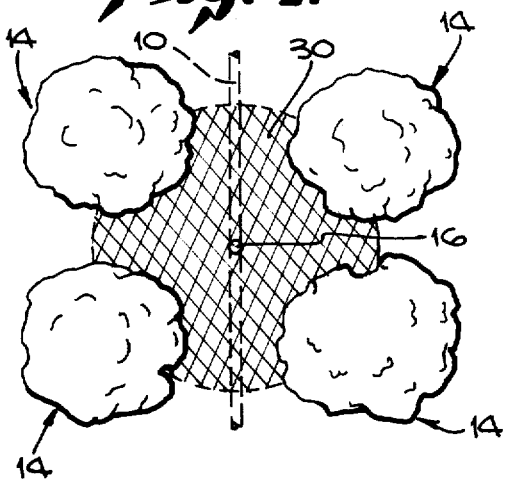
FIG. 2 is a top view of the irrigation system of FIG. 1 showing the horizontal spray pattern created by a single sprinkler head being employed to irrigate four trees.
Figure 3:
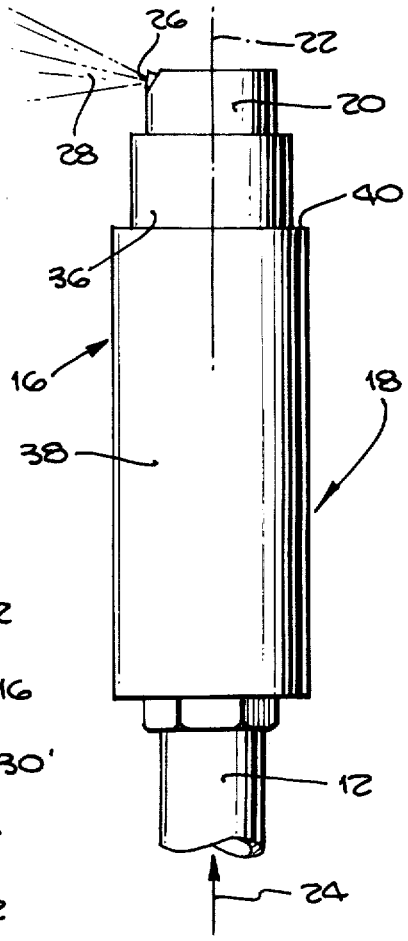
Fig. 3. PRIOR ART
FIG. 3 is a simplified elevation view of a sprinkler head of a type wherein the present invention is adapted for use.
Figure 4:
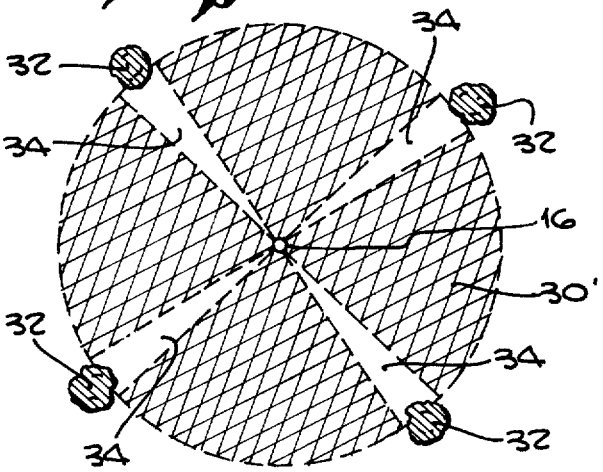
FIG. 4 is a plan view of the irrigation pattern created by a sprinkler head of the type shown in FIG. 3 when employing the present invention with four stream splitting fins.
Figure 11:
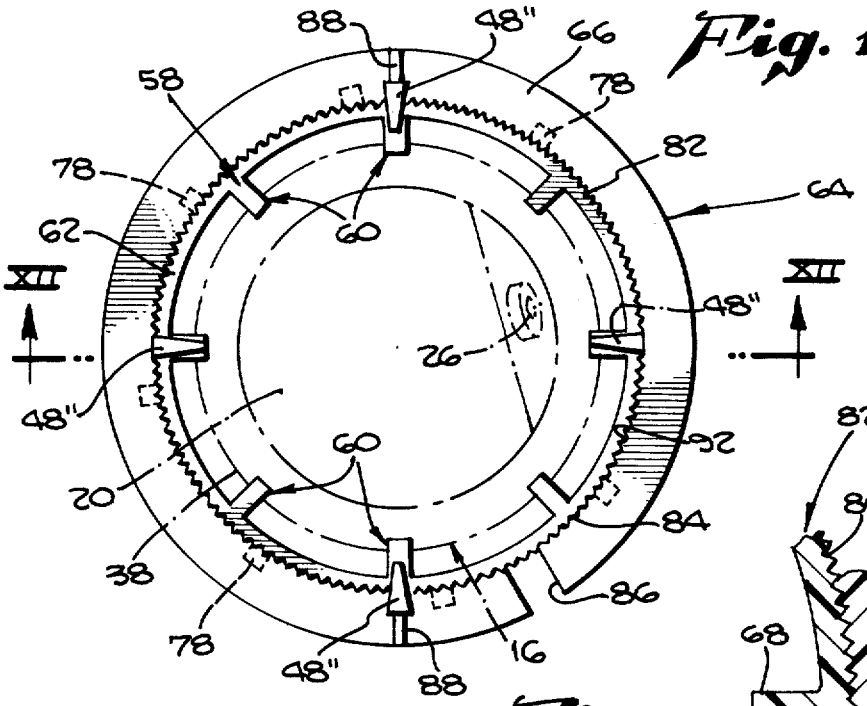
FIG. 11 is a plan view of the preferred embodiment of the present invention of FIG. 10.

As previously mentioned, the rotating sprinkler head of FIG. 3 is typically employed in watering orchards and continuously rotates in a single direction about the longitudinal axis 22 to create the 360° horizontal spray pattern 30 of FIG. 2. What is desired, is the creation of a horizontal spray pattern 30' as shown in FIG. 4 wherein the water which would otherwise strike the tree trunks 32 is split in the areas designated 34 to create a narrow dry wedge-shaped area radially aligned with each tree trunk 32 such that the water falls on either side of the tree trunks 32 but not thereon while creating only very narrow split areas 34 so as to be virtually non-existent with respect to the water delivered to the underground roots (not shown) of the trees.

Referring once again briefly to FIG. 3, spinkler heads of the type shown in FIG. 3 at least as produced by the assignee of the present application, not only have a cylindrical body portion 18, but the cylindrical body portion 18 terminates in a cylindrical upper portion 36 of lesser diameter than the main portion 38 thereby creating a shoulder 40. While the invention to be described hereinafter in its various embodiments (and other obvious variations not specifically shown but included within the scope and spirit thereof) could be used with sprinkler heads of the cylindrical type not employing such a design, the smaller upper cylindrical portion 36 and shoulder 40 provide a particularly beneficial environment for the mounting of the stream splitter of the present invention and the maintenance thereof in a non-changing position during extended periods of operation of the sprinkler system. That is, it is particularly desirable in such applications that the individual sprinkler heads be adjusted initially and thereafter operate for extended periods without worry that the adjustment has changed causing the tree trunks to be placed in a constantly wet condition. As will be seen hereinafter, the various embodiments described, and in particularly that of the preferred embodiment, incorporate various features to assure both adjustability and resistance to undesired self-adjustment.

Turning now to FIGS. 5 through 8, a first embodiment of the present invention is shown. In this embodiment, a cylindrical collar 42 is adapted to be fitted snugly over the cylindrical upper portion 36 resting on shoulder 40. The upper surface 44 of collar 42 has a plurality of radially equally spaced holes 46 formed therein. The holes 46 are adapted to receive one or more removable stream splitting fins 48 as shown in FIG. 7. Fins 48 have a wedge-shaped upper portion 50 as best seen with reference to FIG. 8. A cylindrical peg 52 extends from the bottom of fin 48. Cylindrical peg 52 is sized to snugly fit into holes 46. When so positioned, the collar 42 with a fin 48 inserted therein appears as shown in FIG. 6. The fin 48 is positioned such that the narrow edge 54 of the wedge shape is pointed towards the rotational center of nozzle portion 20. Each fin 48 is positioned in a hole 46 so as to be disposed radially between the rotational center of nozzle portion 20 and a tree trunk to be protected.

Turning now to FIG. 9, a second embodiment of the present invention is shown. In this embodiment, a cylindrical collar 56 is once again employed to fit snugly over cylindrical upper portion 36. In this case, however, cylindrical collar 56 is of a thickness in the longitudinal direction less than half the length of cylindrical upper portion 36. Additionally, the stream splitting fin 48' is affixed directly to the outer periphery of cylindrical collar 56 rather than to the upper surface as in the previous embodiment. By so doing, two such cylindrical collars 56 can be stacked one upon the other to provide two stream splitting fins 48' with an infinite radial position adjustability. While not shown, the cylindrical collar 56 could be made even thinner in the longitudinal direction whereby three or four collars could be stacked one upon the other round cylindrical upper portion 36 to provide additional infinitely adjustable stream splitting fins. As an alternative, more than one stream splitting fin 48' could be permanently affixed to each cylindrical collar 56 as, for example, two stream splitting fins 48' disposed 180° apart.

The preferred embodiment of the present invention will now be described with reference to FIGS. 10 through 15. The preferred embodiment operates on the same principle as the two simplified versions described above but is a commercial version to be sold by the assignee of the present application and incorporates several features to provide ease of adjustability while assuring, to the greatest extent possible, that the device will stay in alignment despite the vibrations of a constantly operating sprinkler system.

The preferred embodiment is shown in FIG. 10 in elevation view as mounted on a sprinkler head 16. An inner collar 58 is disposed about cylindrical upper portion 36 in the manner of the collars 42, 56 of the previous embodiments. Inner collar 58 is cylindrical in shape but, contrary to the two previous embodiments, does not have its cylindrical inner surface directly in contact with the outer surface of cylindrical upper portion 36. Rather, a series of fingers 60 extend radially inward to contact the outer surface of cylindrical upper portion 36. The form and benefits of this mounting will be discussed in greater detail hereinafter. Inner collar 58 has a pair of vertical stream splitting fins 48'' extending vertically upward from the upper surface 62. Fins 48'' are disposed 180° apart. An outer cylindrical collar 64 is disposed about inner collar 58 for rotation thereabout. Outer collar 64 also has a pair of 180° opposed vertical fins 48'' on the upper surface 66 thereof. The mating inner surface of outer cylindrical collar 64 and outer surface of inner collar 58 will be discussed in greater detail hereinafter. As will be seen, they are designed to be rotatable yet lock into position.

Figures 14, 15:
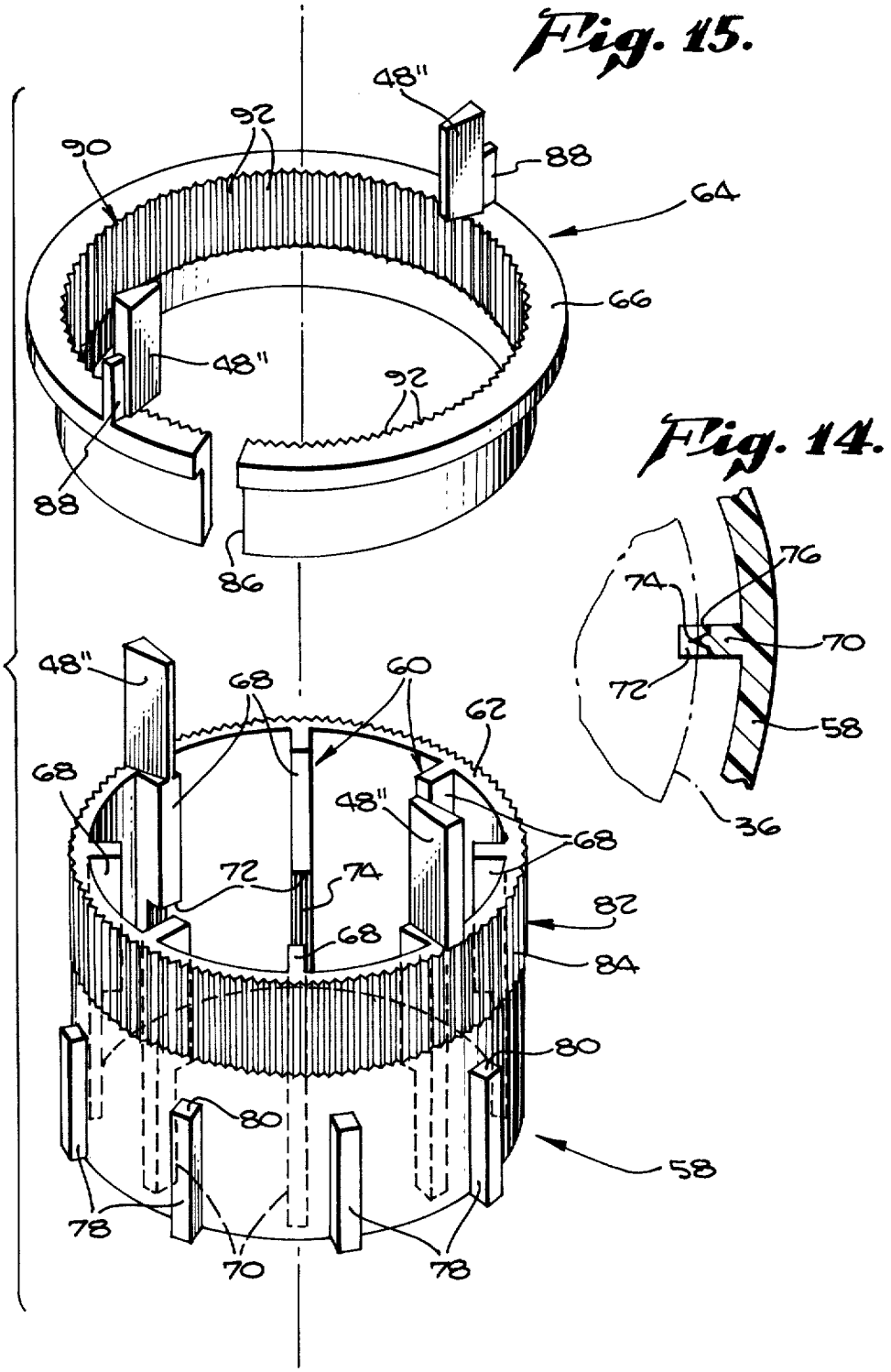
FIG. 14 is a cut-away view of FIG. 12 in the plane XIV—XIV.
FIG. 15 is an exploded view of the preferred embodiment.

Turning now to FIGS. 11 through 15, inner collar 58 can be seen in greater detail. As shown therein, inner collar 58 has eight fingers 60 disposed at 45° intervals about the inner surface thereof. Each finger 60 comprises an upper half 68 and a lower half 70. The lower half 70 extends radially inward from the outside edge a shorter distance than the upper half 68 such that a shoulder 72 is formed therebetween. While the shape of upper half 68 is shown to be rectangular in cross-section, it is relatively unimportant inasmuch as only the shoulder 72 is of interest. By contrast, the lower half 70 is shaped as shown in FIG. 14. As can be seen, the inner facing surface is configured as a triangular ridge in cross section. The inner diameter of the tips 74 of the triangular ridges 76 on the lower half 70 of fingers 60 is made to the slightly smaller than the diameter of the cylindrical upper portion 36 of the sprinkler 16. Inner collar 58 (as with the balance of the invention being described herein) is constructed of injection molded plastics of the type used in manufacturing contemporary sprinkler heads such as sprinkler head 16 of FIG. 3. As such, the material has a slight compressibility. As shown by the ghosted lines of FIG. 12, inner collar 58 is positioned over cylindrical upper portions 36 with lower half 70 concentrically about cylindrical upper portions 36 and shoulder 72 of fingers 60 in abutment with shoulder 40 of cylindrical upper portion 36. The triangular ridges 76 being under slight compression tend to grip the cylindrical upper portion 36 maintaining inner collar 58 where positioned while, at the same time, allowing inner collar 58 to be rotated to place the two stream splitting fins 48'' thereon in alignment as desired. As can be seen from the ghosted nozzle portion 20 in FIG. 12, with inner collar 58 so positioned, the two stream splitting fins 48'' are close adjacent the nozzle opening 26 in its path of rotation. In this manner, the emerging stream of irrigation water 24 is split cleanly before the stream has had sufficient chance to begin its dispersion pattern. As can be seen the two stream splitting fins 48' are conveniently positioned above two of the fingers 60 on top of the upper half 68 thereof. Additionally, eight external ridges 78 are formed radially outward on the lower portion of the external surface of inner collar 58. Ridges 78 perform two functions. First, they allow inner collar 58 to be gripped securely when being rotated to position the stream splitting fins 48''. Second, the tops of external ridges 78 terminate in shoulders 80 which are used in conjunction with outer collar 64 in a manner to be described shortly. Referring to FIG. 15 with particularity, it will be seen that the upper edge of the outer periphery of inner collar 58 has a band 82 of ridges 84 formed therein. In the preferred embodiment, ridges 84 are triangular ridges having peak angles and valley angles of 90°. The band 82 of ridges 84 interact with a mating band of ridges on outer collar 64 to be described shortly.

Turning now to the outer cylindrical collar 64, as can best be seen with reference to FIG. 15, outer cylindrical collar 64 is incomplete. That is, it has a break 86 longitudinally in one side thereof. Break 86 in conjunction with the plastic material provides the necessary springiness to outer cylindrical collar 64 as will be understood from the description which follows hereinafter. The two stream splitting fins 48'' on outer cylindrical collar 64 are positioned radially inward as much as possible, as can best be seen with reference to FIG. 11, in order to position them as close as possible to be close adjacent nozzle opening 26 in its rotational path. Each vertical fin 48'' is secured to the upper surface 66 of cylindrical collar 64 by a ridge member 88. The two ridge members 88 provide two functions. First, they stiffen the two stream splitting fins 48'' inasmuch as only a portion thereof is connected to the upper surface 66. Additionally, they provide a gripping surface in the manner of external ridges 78 for securely gripping cylindrical collar 64 during the adjusting process.

Figure 13:
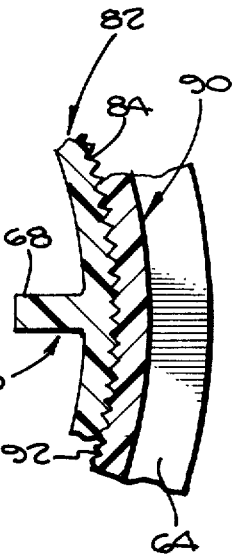
FIG. 13 is a cut-away view of of FIG. 12 in the plane XIII—XIII.
Figure 12:
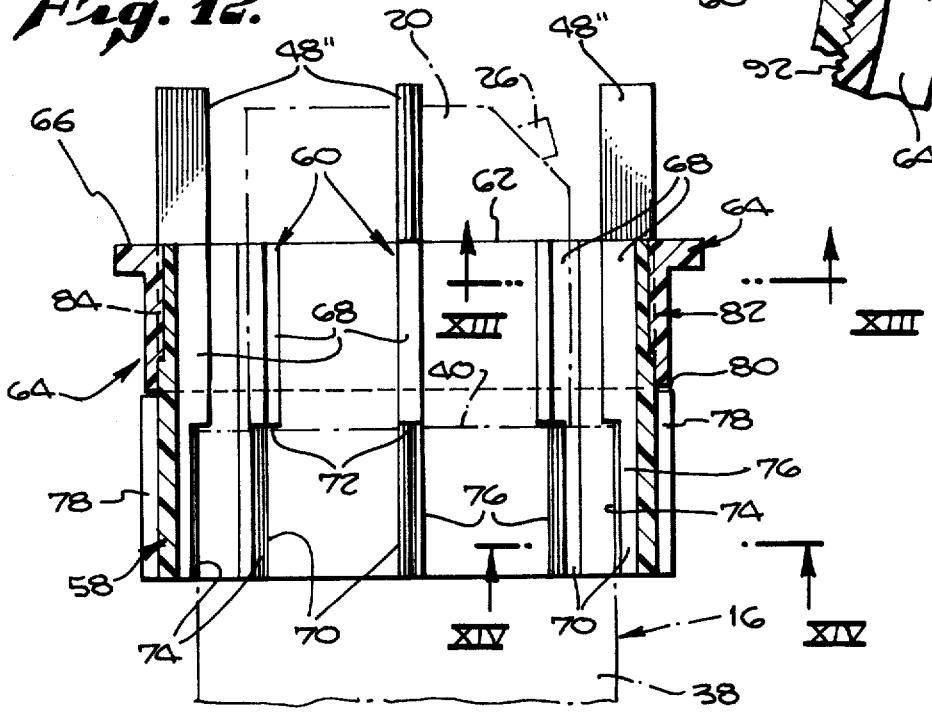
FIG. 12 is a cut-away view of the embodiment of FIG. 11 in the plane XII—XII.

As best seen in FIG. 15, the upper portion of the inner periphery of outer cylindrical collar 64 is provided with a band 90 of ridges 92 adapted to mate with band 80 of ridges 84 on inner collar 58. The inner diameter of outer cylindrical collar 64 is made to be substantially identical to the outer diameter of inner collar 58 in the region of band 82. In this manner, outer cylindrical collar 64 can be slipped concentrically about inner collar 58 with the ridges 92 thereof in engagement with the ridges 84 of inner collar 58 as best shown in FIG. 13. With inner collar 58 and outer collar 64 so positioned, the two are rotated relative to one another by gripping ridges 92 and ridges 84 and rotating the two collars 58, 64 with respect to one another. In so doing, break 86 allows outer collar 64 to flex and expand to allow ridges 84 and 92 to disengage and pass over one another. When released, the springiness of outer cylindrical collar 64 forces the ridges 84, 92 into secure engagement with one another to resist movement as a result of vibrations in the sprinkler head 16 during operation.

Thus, it can be seen from the foregoing description that the present invention in its various embodiments has provided an attachment for sprinkler heads to be employed in the irrigation of orchard crops wherein the tree trunks are prevented from being maintained in a constantly wet position according to the stated objectives.

Wherefore, having thus described my invention, I claim:

1. In a sprinkler head having a vertically disposed cylindrical body adapted for attachment to a source of irrigation fluid under pressure and a nozzle portion extending vertically longitudinally from the body and concentric therewith for continuous rotation to create a horizontal spray pattern over a circular area with water emitted as a stream from a nozzle opening in the nozzle portion, the attachment for splitting the stream which would otherwise strike the trunks of the trees when the sprinkler head is disposed between a plurality of trees to irrigate them to, thereby, prevent trunk rot, said attachment comprising:

(a) a first cylindrical collar adapted to be disposed concentrically about the cylindrical body, said first collar having gripping means on the inner surface thereof for gripping the cylindrical body when disposed concentrically thereabout an amount sufficient to hold said collar from moving out of position from the operational vibrations of the sprinkler head while allowing said collar to be manually rotated into a desired position;

(b) a first wedge-shaped fin member carried by said first collar on one end and disposed vertically close adjacent the nozzle portion with the narrow edge of the wedge facing the nozzle opening when the nozzle opening, a first tree, and said first fin member are in radial alignment whereby the emitted stream of fluid would strike the first tree trunk is split by said first fin member and the fluid thereof is directed to the area beside said first tree;

(c) a second cylindrical collar adapted to be concentrically disposed about said first cylindrical collar, said second cylindrical collar having gripping means on the inner surface thereof for gripping said first cylindrical collar when disposed concentrically thereabout an amount sufficient to hold said second collar from moving out of position with respect to said first collar from the operational vibrations of the sprinkler head while allowing said second collar to be manually rotated with respect to said first collar into a desired position; and, (d) a second wedge-shaped fin member carried by said second collar on one end and disposed vertically close adjacent the nozzle portion with the narrow edge of the wedge facing the nozzle opening when the nozzle opening, a second tree, and said second fin member are in radial alignment whereby the emitted stream of fluid which would strike the trunk of said second tree is split by said second fin member and the fluid thereof is directed to the area beside said second tree.

2. The sprinkler head attachment of claim 1 wherein:

(a) said first cylindrical collar has a pair of said first wedge-shaped fin members mounted thereon 180° apart; and, (b) said second cylindrical collar has a pair of said second wedge-shaped fin members thereon disposed 180° apart.

3. The attachment to a sprinkler head of claim 1 wherein:

said gripping means of said first cylindrical collar comprises a plurality of radially inward facing finger members of a resiliently compressible material.

4. The attachment to a sprinkler head of claim 1 wherein:

said first cylindrical collar has gripping means on the external surface thereof adapted to cooperate with said gripping means of said second collar to prevent relative rotation therebetween.

5. The attachment to a sprinkler head of claim 4 wherein:

(a) said gripping means on said collars are longitudinal rows of interlocking ridges; and, (b) said second cylindrical collar contains a longitudinal split therein to allow said collar to flex and expand as said collars are rotated relative to one another whereby said interlocking ridges can ride over one another during periods of adjustment.

6. In a sprinkler head having a vertically disposed cylindrical body suited for attachment to a source of fluid under pressure and a nozzle portion extending vertically longitudinally from the body and concentric therewith for rotation to create a horizontal spray pattern over a circular arc with fluid emitted as a stream from a nozzle opening in the nozzle portion, an improvement for preventing a direct wetting of the trunks of trees located within the spray pattern comprising:

(a) a first cylindrical collar suited to be concentrically disposed about the cylindrical body;

(b) a second cylindrical collar suited to be concentrically disposed about the cylindrical body on top of said first collar;

(c) a first wedge-shaped fin member carried by said first collar on one end and disposed vertically close adjacent the nozzle portion with the narrow edge of the wedge facing the nozzle opening when the nozzle opening, a first tree, and said first fin member are in radial alignment, whereby the emitted stream of fluid which would strike the tree trunk is split by said first fin member and the fluid thereof is directed to the area beside the first tree, and wherein said first fin member is mounted on the outer periphery of said first collar to thereby pass alongside said second collar; and (d) a second wedge-shaped fin member carried by said second collar on one end and disposed vertically close adjacent the nozzle portion with the narrow edge of the wedge facing the nozzle opening when the nozzle opening, a second tree, and said second fin member are in radial alignment, whereby the emitted stream of fluid which would strike the tree trunk is split by said second fin member and the fluid is directed to the area beside the second tree.

7. In a sprinkler head having a vertically disposed cylindrical body suited for attachment to a source of fluid under pressure and a nozzle portion extending vertically longitudinally from the body and concentric therewith for rotation to create a horizontal spray pattern over a circular arc with fluid emitted as a stream from a nozzle opening in the nozzle portion, an improvement for preventing a direct wetting of the trunks of trees located within the spray pattern comprising:

(a) a first cylindrical collar suited to be concentrically disposed about the cylindrical body;

(b) a first wedge-shaped fin member carrier by said first collar on one end and disposed vertically close adjacent the nozzle portion with the narrow edge of the wedge facing the nozzle opening when the nozzle opening, a first tree, and said first fin member are in radial alignment whereby the emitted stream of fluid which would strike the tree trunk is split by said first fin member and the fluid thereof is directed to the area beside the first tree;

(c) a second cylindrical collar suited to be concentrically disposed about said first collar; and (d) a second wedge-shaped fin member carried by said second collar on one end and disposed vertically close adjacent the nozzle portion with the narrow edge of the wedge facing the nozzle opening when the nozzle opening, a second tree, and said second fin member are in radial alignment.

8. The improvement to sprinkler heads of claim 7 wherein:

said second cylindrical collar has gripping means on the inner surface thereof for gripping the first cylindrical collar when disposed concentrically thereabout an amount sufficient to hold said second collar from moving out of position from the operational vibrations of the sprinkler head while allowing said second collar to be manually rotated with respect to said first collar into a desired position.

9. The improvement to sprinkler heads of claim 8 wherein:

said first cylindrical collar has gripping means on the external surface thereof adapted to cooperate with said gripping means of said second collar to prevent relative rotation therebetween.

10. The improvements to sprinkler heads of claim 9 wherein:

(a) said gripping means on said collars are longitudinal rows of interlocking ridges; and, (b) said second cylindrical collar has a longitudinal split therein to allow said collar to flex and expand as said second collar and said first collar are rotated relative to one another whereby said longitudinal rows of interlocking ridges can ride over one another during period of rotational adjustment and thereafter resume their interlocked position to prevent relative rotation.

11. A sprinkler head, which comprises:

(a) a nozzle which is rotatable about a substantially vertical axis of rotation, wherein the nozzle has a nozzle opening configured to emit a fluid therefrom in a relatively cohesive stream, wherein the nozzle opening is angled relative to the axis of rotation to create a horizontal spray pattern over an arc of a circle; and (b) means for preventing the fluid stream from wetting a relatively narrow upstanding object located in the spray pattern, wherein the preventing means comprises means for splitting the stream into two portions only when the stream is aligned with the object and for directing the portions of the split stream to the areas on either side of the object.

12. A sprinkler head as recited in claim 11, wherein the preventing means comprises a deflector member fixedly mounted relative to the circular arc traversed by the nozzle.

13. An attachment for a sprinkler head of the type having a body suited to be secured to a source of fluid under pressure and a nozzle extending from and rotatable relative to the body to create a horizontal spray pattern over a circular arc with the fluid emitted as a stream from a nozzle opening in the nozzle, wherein the attachment comprises:

(a) means for preventing the fluid stream from wetting a relatively narrow upstanding object located in the spray pattern, wherein the preventing means comprises means for intercepting the stream when the stream is aligned with the object and for deflecting the intercepted stream to an area substantially immediately adjacent the object, wherein the preventing means comprises a fin member which is wedge-shaped between inner and outer ends with the inner end defining the narrow edge of the wedge and the outer end the large edge of the wedge, wherein the outer end of the fin member is substantially free of fluid deflecting structure; and (b) means for mounting the preventing means on the body, wherein the mounting means locates the fin member in radial alignment with the nozzle opening with the narrow edge of the wedge facing the opening such that the emitted fluid stream is split by the fin member to miss the upstanding object and be directed to the area immediately beside the object.

14. An attachment as recited in claim 13, wherein the mounting means is adjustable on the body to allow the location of the fin member to be varied relative to the arc traversed by the nozzle to allow selective alignment of the fin member with different upstanding objects in the spray pattern.

* * * * *